US006359558B1

(12) United States Patent
Tsui

(10) Patent No.: US 6,359,558 B1
(45) Date of Patent: Mar. 19, 2002

(54) LOW POWER AUDIBLE ALARM RELAY DEVICE FOR A ROLLING CODE SECURITY SYSTEM

(76) Inventor: Philip Y. W. Tsui, 3513 Ingram Road, Mississuga, Ontario (CA), L5L 4M4

( * ) Notice: Subject to any disclaimer, the term of this patent is extended or adjusted under 35 U.S.C. 154(b) by 0 days.

(21) Appl. No.: 09/447,389

(22) Filed: Nov. 22, 1999

Related U.S. Application Data

(63) Continuation-in-part of application No. 09/023,393, filed on Feb. 13, 1998, now Pat. No. 6,243,000.

(51) Int. Cl.[7] ..... G08B 1/00; G10R 11/00

(52) U.S. Cl. ..... 340/531; 340/539; 340/566; 367/197

(58) Field of Search ..... 340/531, 539, 340/566; 367/197–199

(56) References Cited

U.S. PATENT DOCUMENTS 4,189,720 A * 2/1980 Lott ..... 340/531
4,297,677 A * 10/1981 Lewis et al. ..... 340/566
4,450,436 A * 5/1984 Massa ..... 340/531
4,617,555 A 10/1986 Sheiman ..... 340/531
4,885,803 A 12/1989 Hermann et al. ..... 340/825.72
4,897,862 A 1/1990 Nishihara et al. ..... 379/40
5,055,701 A 10/1991 Takeuchi ..... 340/825.69
5,400,011 A * 3/1995 Sutton ..... 340/566
RE35,365 E 10/1996 Heitschel et al. ..... 340/825.73
5,563,600 A 10/1996 Miyake ..... 340/825.3
5,594,429 A 1/1997 Nakahara ..... 340/825.72
5,650,774 A 7/1997 Drori ..... 340/825.31
5,745,040 A 4/1998 Loughridge ..... 340/539
5,774,064 A 6/1998 Lambropoulos et al. ..... 340/825.31
5,786,767 A 7/1998 Severino ..... 340/628

* cited by examiner

*Primary Examiner*—Donnie L. Crosland

(57) ABSTRACT

An alarm relay device including a microphone that produces a signal responsive to an audible alarm having a frequency. A first circuit coupled to the microphone produces a first detect signal when the signal is above a predetermined level. A second circuit coupled to the microphone and the first circuit receives power responsive to the first detect signal. The second circuit produces a second detect signal when the signal is within a predetermined range of the frequency.

32 Claims, 10 Drawing Sheets

LOW POWER AUDIBLE ALARM RELAY DEVICE FOR A ROLLING CODE SECURITY SYSTEM

CROSS-REFERENCES TO RELATED APPLICATIONS

The present application is a continuation-in-part of U.S. patent application Ser. No. 09/023,393, entitled "Wireless Rolling Code Security System" filed Feb. 13, 1998 now U.S. Pat. No. 6,243,000.

BACKGROUND OF THE INVENTION

1. Field of the Invention

This invention is directed in general to security systems and in particular, to a wireless security system in which a peripheral device, which operates with a receiver, is capable of transmitting coded signals relaying an audible alarm to the receiver. The transmitter transmits the coded signals using a different data frame pattern during each transmission.

2. Background Information

Transmitter-receiver controller systems are widely used for remote control and/or actuation of devices or appliances such as garage door openers, gate openers, and security systems. For example, most conventional security systems use a transmitter-receiver combination to monitor selected areas. In such conventional security systems, all the peripheral devices such as sensors, and the control unit operate using the same identification code, so that only those devices belonging to a particular installed security system on the premises can operate with each other. Other devices which operate using a different identification code, would be ignored. In more complicated systems, various groups of peripheral devices may be assigned to different zones, each of which is monitored for quick identification in the event of a security breach.

Such conventional security systems create security risks. Since a single, fixed identification code is utilized, the identification code transmitted by a peripheral device may be detected by a hostile user, and subsequently used to disarm the control unit. Further, a single, fixed identification code may be generated by a non-system source and incorrectly recognized as a system signal.

A security system that uses the present inventive signaling system may have a need for non-system alarm devices that are not equipped to transmit the required signals. These non-system alarm devices may provide only an audible signal.

Accordingly, there is a need in the technology for a security system which provides increased security by having peripheral devices, each having different identification codes which cannot be easily detected. In addition, there is a need for a security system which improves immunity to spurious signals by transmitting a different data frame pattern during each transmission. Further, there is a need for a security system that can include non-system alarm devices by detecting an audible alarm signal and provide the benefits of the secure identification codes and changing transmissions. Still further, there is a need for a circuit for detecting an audible alarm signal that can be battery powered and having a long battery life to allow the circuit to be placed in the vicinity of the audible alarm without requiring a hard-wired power supply or frequent battery maintenance.

SUMMARY OF THE INVENTION

An alarm relay device including a microphone that produces a signal responsive to an audible alarm having a frequency. A first circuit coupled to the microphone produces a first detect signal when the signal is above a predetermined level. A second circuit coupled to the microphone and the first circuit receives power responsive to the first detect signal. The second circuit produces a second detect signal when the signal is within a predetermined range of the frequency.

DETAILED DESCRIPTION OF THE INVENTION

Figure 1A:
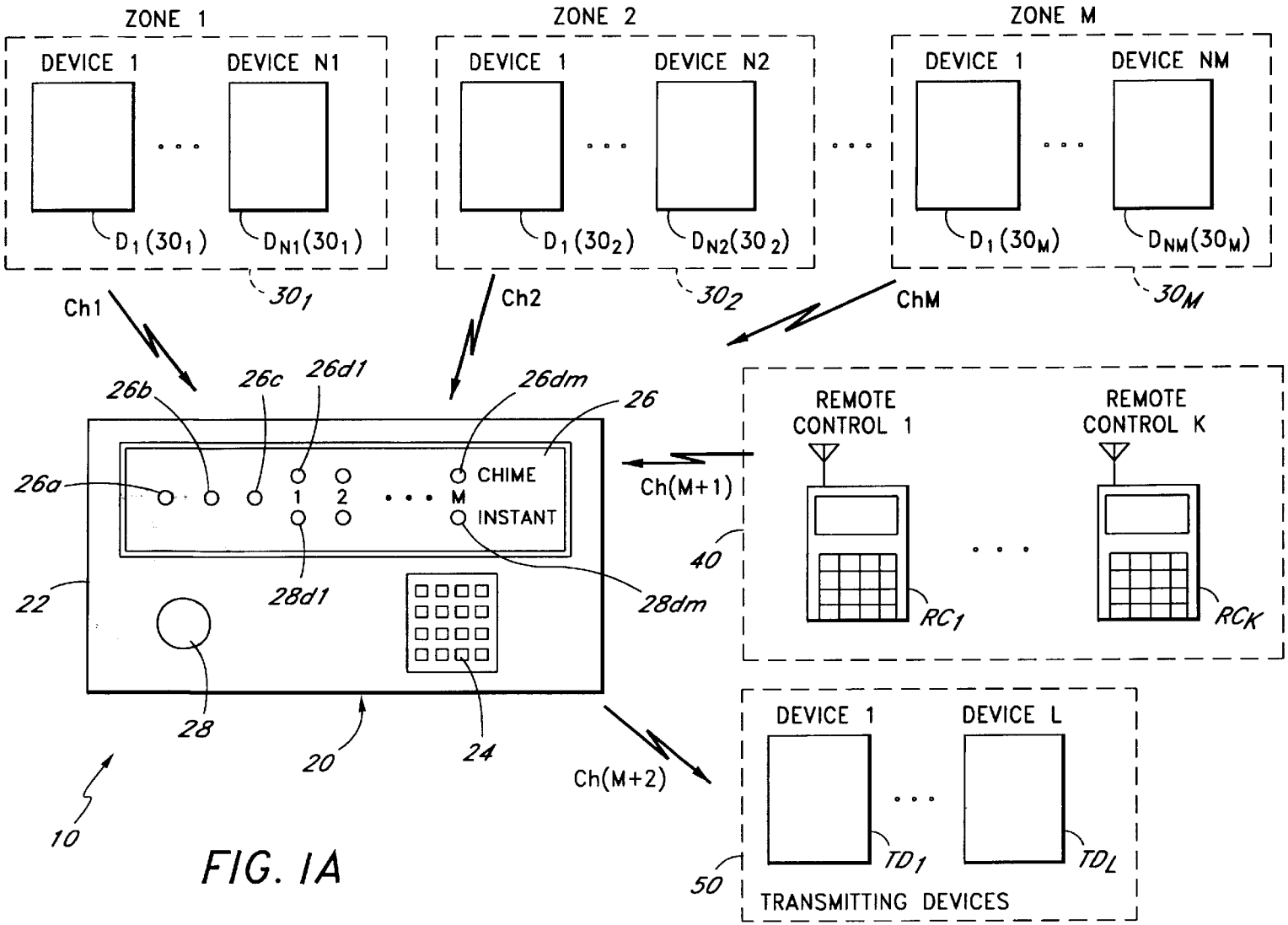
FIG. 1A is a block diagram illustrating one embodiment of the security system of the present invention.

FIG. 1A is a block diagram illustrating one embodiment of the security system of the present invention. The security system 10 comprises a security console 20, a plurality of sets of peripheral devices D1($30_1$)–DN1($30_1$), D1($30_2$)–DN2($30_2$), . . . , D1($30_M$)–DNM($30_M$), each of which is allocated to a zone $30_1$, $30_2$, . . . , $30_M$ respectively, a plurality of remote controllers RC1, . . . RCK (collectively referred to as remote controllers 40), and a plurality of signaling devices SD1, . . . , SDL (collectively referred to as signaling devices 50). Examples of signaling devices 50 include bells, sirens, strobe lights, and telephone auto dialers.

In one embodiment, the number of peripheral devices D1($30_1$)–DN1($30_1$), D1($30_2$)–DN2($30_2$), . . . , D1($30_M$)–DNM($30_M$) are equal, i.e., N1=N2=NM. However, in alternate embodiments, any desired number of peripheral devices may be assigned to a particular zone $30_1$, $30_2$, . . . , $30_M$. Examples of the peripheral devices include sensors such as motion sensors, door/window contacts, and audible alarm relays. An audible alarm relay allows existing non-system alarm devices that produce a local audible alarm, such as smoke detectors, water detectors, freezer alarms, and the like, to be included in the security system 10.

The security console 20 comprises a housing 22, a keypad 24, a display panel 26 and a opening 28 which facilitates the projection of audio signals. In one embodiment, the housing 22 is made from plastic through an injection-molding process. In one embodiment, the keypad 24 is an alphanumeric keypad. In an alternate embodiment, the keypad 24 is a numeric keypad. The display panel 26 comprises a first light emitting diode (LED) 26*a* which indicates the security console 20 is powered up, a second LED 26*b* which indicates that the battery supply is low, a third LED 26*c* which indicates that the security console 20 is armed, a first plurality of zone LEDs 26*d*1, . . . , 26*dm* which correspond to the zones $\mathbf{30}_1$, . . . , $\mathbf{30}_m$, each of which will light up indicating that a chime will sound when a corresponding one of the peripheral devices are activated, and a second plurality of zone LEDs 28*d*1, . . . , 28*dm* which correspond to the zones $\mathbf{30}_1$, . . . , 30*m*, each of which will light up indicating that an alarm will sound instantly when an associated one of the peripheral devices is activated. Selection of either the chime mode or the alarm mode may be made during installation of the security system 10 by configuring the micro-controller 100.

Figure 1B:
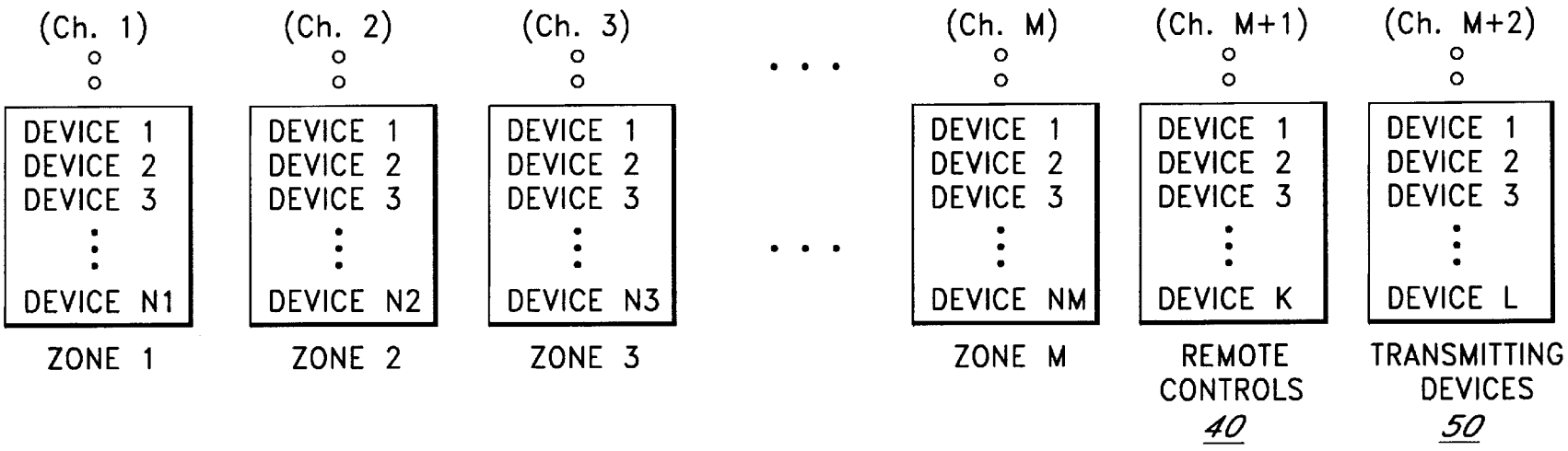
FIG. 1B is a block diagram illustrating one embodiment of the zone/channel organization implemented in the security system of FIG. 1A.

As discussed earlier, each of the peripheral devices D1($\mathbf{30}_1$)–DN1($\mathbf{30}_1$), D1($\mathbf{30}_2$)–DN2($\mathbf{30}_2$), . . . , D1($\mathbf{30}_M$)–DNM($\mathbf{30}_M$), is allocated to a zone $\mathbf{30}_1$, $\mathbf{30}_2$, . . . , $\mathbf{30}_M$ respectively. For example, the user may assign his living room as zone $\mathbf{30}_1$, and install various peripheral devices such as electrical or motion sensors to zone $\mathbf{30}_1$. FIG. 1B is a block diagram illustrating one embodiment of the zone/channel organization implemented in the security system of FIG. 1A. The security console 20 monitors the devices D1($\mathbf{30}_1$)–DN1($\mathbf{30}_1$), D1($\mathbf{30}_2$)–DN2($\mathbf{30}_2$), . . . and/or D1($\mathbf{30}_M$)–DNM($\mathbf{30}_M$), corresponding to a zone $\mathbf{30}_1$, $\mathbf{30}_2$, . . . , and/or $\mathbf{30}_M$ respectively, via a plurality of channels Ch1, Ch2, . . . , ChM respectively. Two other channels, namely, ChM+1 and ChM+2 are implemented for reception of signals from one or more remote controllers 40 and transmission of signals to one or more signaling devices 50.

Figure 2A:
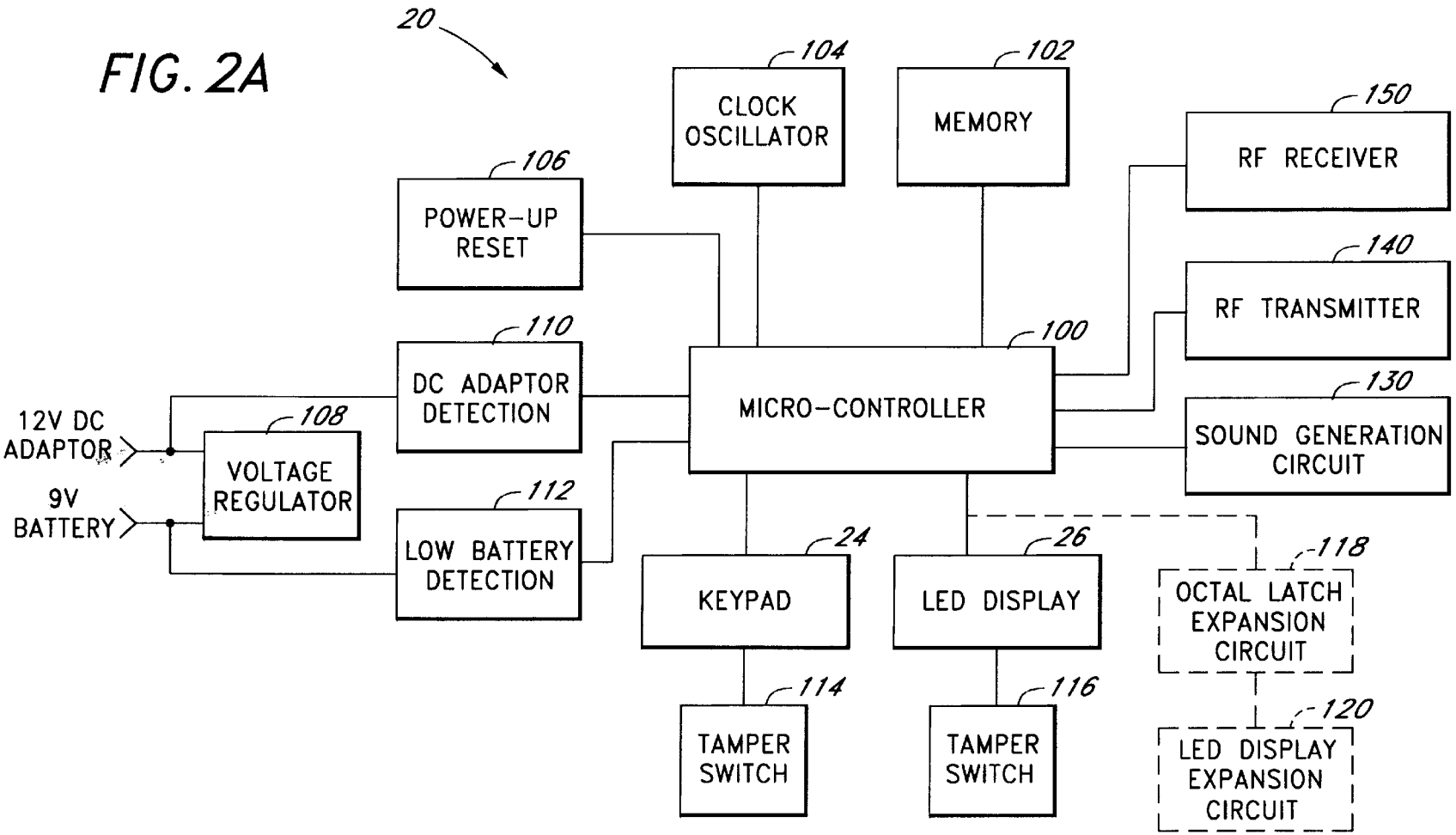
FIG. 2A is a detailed block diagram of one embodiment of the security console 20 of FIG. 1A.

FIG. 2A is a detailed block diagram of one embodiment of the security console 20 of FIG. 1A. The security console 20 comprises a micro-controller 100, memory 102 such as a non-volatile memory, a clock oscillator 104, a power-up reset circuit 106, a voltage regulator 108 which receives current and voltage from either a 12V direct current (DC) source or a 9V battery, a low battery detection circuit 112, the keypad 24 which may be used to enter a password for gaining access to the security console 20, the LEDs on the LED display panel 26, tamper switches 114 and 116 which are coupled to the keypad 24 and LED display panel 26 respectively, an optional octal latch expansion circuit 118, and an optional LED display expansion circuit 120, a sound generation circuit 130, a radio frequency (RF) transmitter 140 and an RF receiver 150. In one embodiment, the micro-controller 100 may be replaced by a processor. The octal latch expansion circuit 118 and the LED display expansion circuit 120 (FIG. 2A) may be implemented in the security console 20 to provide additional storage and input/output capability.

Figure 2B:
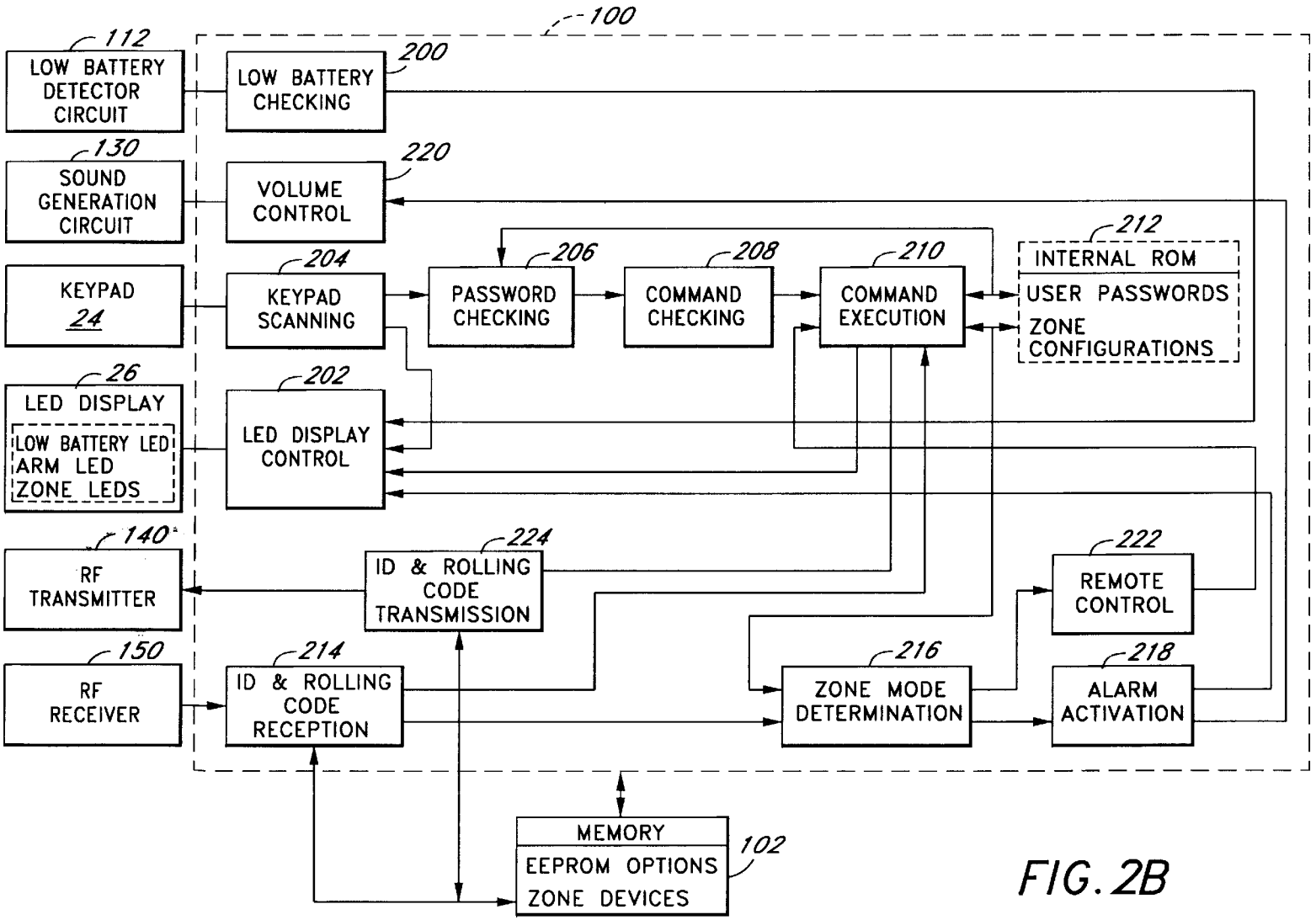
FIG. 2B is one embodiment of a functional block diagram of the micro-controller 100 of FIG. 2A.

FIG. 2B is one embodiment of a functional block diagram of the micro-controller 100 of FIG. 2A. The memory 102 stores information regarding the peripheral devices, e.g. D1($\mathbf{30}_1$)–DN1($\mathbf{30}_1$), D1($\mathbf{30}_2$)–DN2($\mathbf{30}_2$), . . . , D1($\mathbf{30}_M$)–DNM($\mathbf{30}_M$), that are stored in each zone, including the identification codes of each device. In particular, upon activation of each device, a unique identification code and an associated variable security (or rolling) code is transmitted from the device to the security console 20. Memory 102 also stores software which enables the user to assign each device to a particular zone. Such zone assignment or configuration is also stored in memory 102. In one embodiment, each zone corresponds to a particular location of the facility that is being monitored, for example, a first zone may be assigned to include a reception area, while a second zone may be assigned to include a storage room. Alternatively, a first zone may be assigned to include a garage, while a second zone may be assigned to include a bedroom. Upon installing and activating a first device, a signal including a unique identification code and an associated rolling code is transmitted from the first device to the security console. The user may assign the first device to a first monitoring zone to facilitate ease of monitoring. Upon installing a second device in the same general location, a signal including a unique identification code and an associated rolling code is transmitted from the second device to the security console. The user may also assign the second device to the first monitoring zone, to facilitate monitoring of the location of interest. Additional devices for monitoring a selected area may accordingly be assigned to the first monitoring zone.

Likewise, one or more devices may be assigned to one or more additional monitoring zones. In one embodiment, Zone 1 may be assigned to monitor N1 devices, Zone 2 may be assigned to monitor N2 devices, . . . , and Zone M may be assigned to monitor NM devices, where N1, N2 and NM are integers.

The low battery detection circuit 112 provides signals to the micro-controller 100 when the battery level falls below a predetermined level. This signal is monitored by the micro-controller 100 as shown in functional block 200. Upon detection of the predetermined level, the micro-controller 100 sends a command to the LED display 26 to light up the low battery LED 26*b* (see functional block 202). The micro-controller 100 also scans the keypad 24 (functional block 204) to interpret the numerical codes entered via the keypad 24. The micro-controller 100 also determines if the numerical codes entered matches one of the passwords (functional block 206) stored in an internal RAM 212. If so, the micro-controller 100 issues a command that is first verified (functional block 208) and then executed (functional block 210), enabling the user to gain access to the micro-controller 100. The micro-controller 100 also detects the power available provided via either a 12V DC adapter or a battery (see FIG. 2A) and when the security console 20 is powered up, the micro-controller 100 lights up a first light emitting diode (LED) 26*a* which indicates the console is powered up. Upon receiving a user input indicating that the console 20 is armed, the micro-controller 100 lights up a third LED 26*c*. In addition, the micro-controller 100 also controls the status of a first plurality of zone LEDs 26*d*1, . . . , 26*dm* which correspond to the zones 301, . . . , 30*m*, each of which indicate that a chime will sound when an associated one of the peripheral devices are activated, and a second plurality of zone LEDs 28*d*1, . . . , 28*dm* which correspond to the zones 301, . . . , 30*m*, each of which indicate that an alarm will sound instantly when an associated one of the peripheral devices is activated.

As discussed earlier, the micro-controller 100 also receives signals from the RF receiver 150 (functional block 214), which forwards any received signals from the devices in Zone 1, Zone 2, . . . , Zone M (see FIG. 1) to the micro-controller 100. The signals, which includes a unique identification code and a variable security or rolling code. The received signal is processed to determine if it originates from one of the monitored zones, and if so, to determine if it is a valid signal (functional block 216). If so, the microcontroller 100 determines if an alarm should be activated (functional blocks 218 and 220) or if a signal should be transmitted to one of the remotely located signaling devices 50, which subsequently dials an outside number, indicating that a security violation has occurred (functional blocks 222, 210, 224 and RF transmitter 140). Such a determination may be accomplished by pre-programming the micro-controller 100.

The micro-controller 100 may likewise receive signals from any one of the remote controllers 40, each of which includes a unique identification code and a variable security or rolling code. The remote controllers 40 may each be carried by an authorized user, for gaining access to the security console 20, for arming or disarming the security console 20 or for actuating one of the peripheral devices of $D1(30_1)$–$DN1(30_1)$, $D1(30_2)$–$DN2(30_2)$, . . . , $D1(30_M)$–$DNM(30_M)$ in the monitored zones. Transmissions initiated by the security console 20 (functional blocks 210, 224) to the signaling devices 50 are accomplished using a signal having a unique identification code and variable security (or rolling) code in accordance with the present invention.

In one embodiment, the security console 20 includes a housing 22 that encloses the above-described circuitry. The housing (including the keypad 24 and LED display 26) is coupled to tamper switches 114 and 116, via a tamper detection circuit (not shown) which determines if the housing is subject to a predetermined level of pressure that is indicative of attempted or actual tampering or breakage. Upon detection of a level that is at or above a predetermined level of pressure, the micro-controller 100 issues a command to either activate an alarm (functional blocks 210, 216, 218) or to transmit a signal to one of the remotely located signaling devices 50, which subsequently dials an outside number, indicating that a security violation has occurred (functional blocks 222, 210, 224 and RF transmitter 140). Such a determination may be accomplished by pre-programming the microcontroller 100.

Figure 3A:
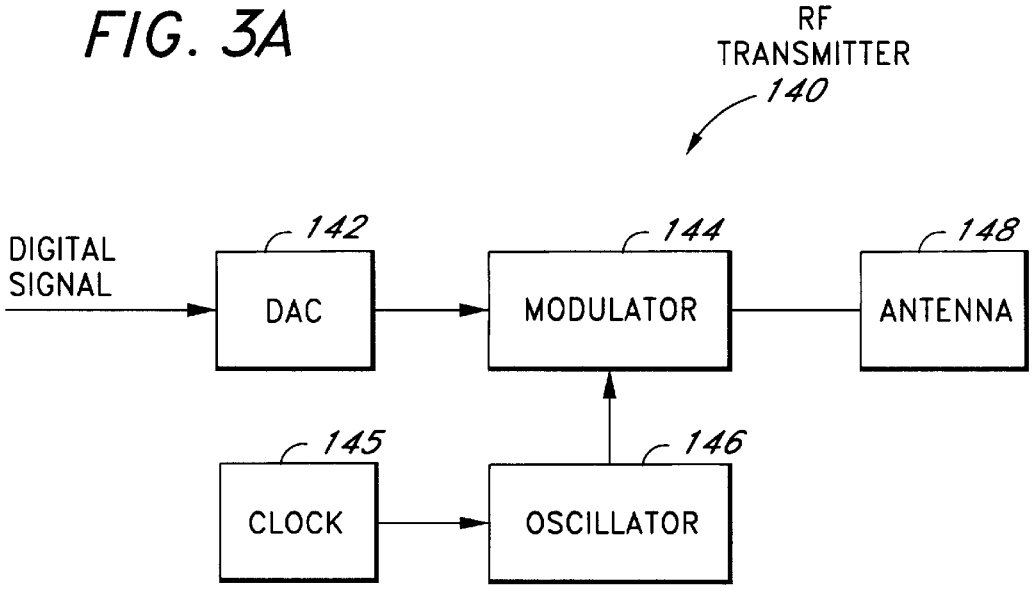
FIG. 3A is a detailed block diagram of one embodiment of the RF Transmitter 140 of FIG. 1A.

FIG. 3A is a detailed block diagram of one embodiment of the RF transmitter 140 of FIG. 2A. The RF transmitter 140 comprises a digital to analog converter 142, which converts the digital signal generated by the micro-controller 100 to an analog signal, a modulator 144, which modulates the analog signal and subsequently provides the modulated analog signal to antenna 148. The modulator 144 receives the carrier frequency from an oscillator 146, which is driven by clock 145.

Figure 3B:
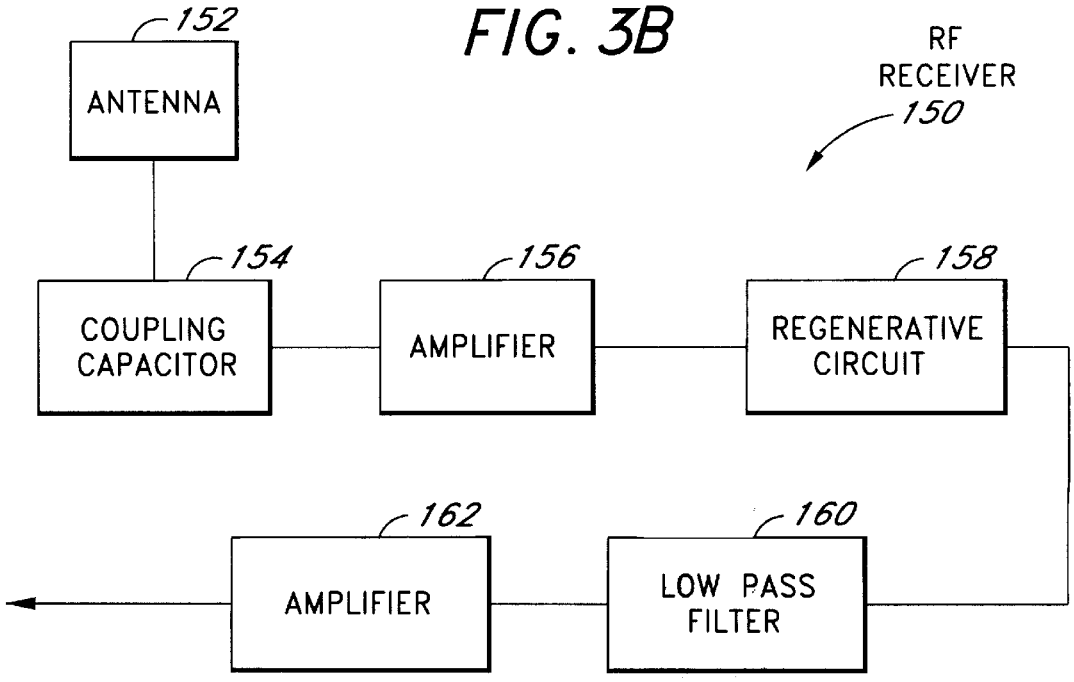
FIG. 3B is a detailed block diagram of one embodiment of the RF Receiver 150 of FIG. 1B.

FIG. 3B is a detailed block diagram of one embodiment of the RF Receiver 150 of FIG. 2A. The RF receiver 150 comprises an antenna 152 for receiving incoming signals, a coupling capacitor 154, an amplifier 156 for amplifying the received signals, a regenerative circuit 158 which performs equalization, timing and decision making processes on the received signals so as to minimize the effects of amplitude and phase distortions on the received signals, a low pass filter 160 for filtering the signals and another amplifier 162 which amplifies the filtered signal. The resulting signal is forwarded to the micro-controller 100.

Figure 4B:
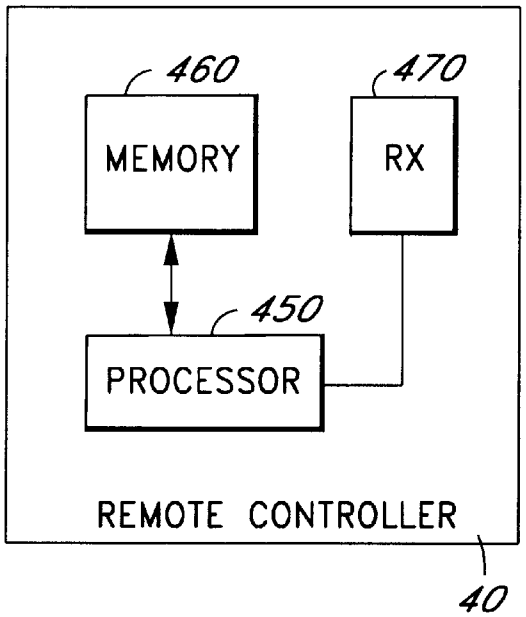
FIG. 4B illustrates one embodiment of any one of the signaling devices 50.
Figure 4A:
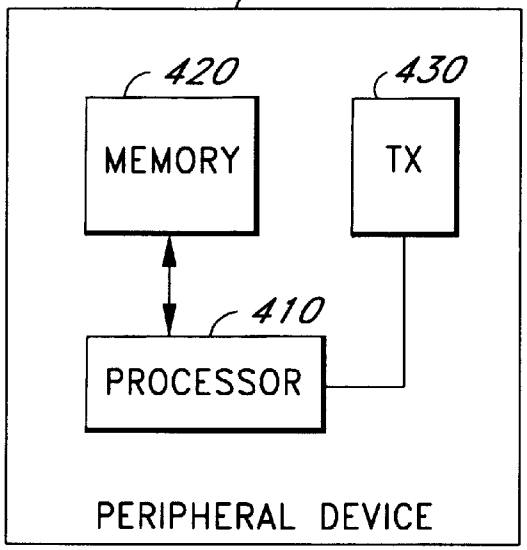
FIG. 4A illustrates one embodiment of any one of the peripheral devices D1($30_1$)–DN1($30_1$), D1($30_2$)–DN2($30_2$), . . . D1($30_M$)–DNM($30_M$) or remote controller 40.

FIG. 4A illustrates one embodiment of any one of the peripheral devices $D1(30_1)$–$DN1(30_1)$, $D1(30_2)$–$DN2(30_2)$, . . . $D1(30_M)$–$DNM(30_M)$ or remote controller 40. The peripheral device 400 comprises a processor 410, memory 420 and a transmitter 430. The transmitter 430 of a peripheral device or remote controller 40 is comparable to the RF transmitter 140 of the security console 20 shown in FIG. 3A. FIG. 4B illustrates one embodiment of any one of the signaling devices 50. The signaling device 50 comprises a processor 450, memory 460 and a receiver 470. The receiver 470 of a signaling device 50 is comparable to the RF receiver 150 of the security console 20 shown in FIG. 3B.

Figure 4C:
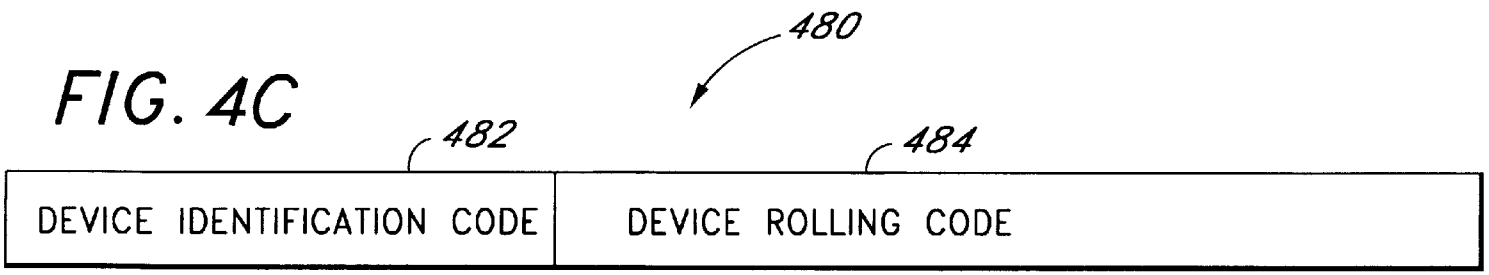
FIG. 4C illustrates the format 480 of the signal transmitted from any of the devices D1($30_1$)–DN1($30_1$), D1($30_2$)–DN2($30_2$), . . . D1($30_M$)–DNM($30_M$), and/or remote controllers 40, to the security console 20, and from the security console 20 to any of the signaling devices 50.

FIG. 4C illustrates the format of the coded signal 480 transmitted from any of the devices $D1(30_1)$–$DN1(30_1)$, $D1(30_2)$–$DN2(30_2)$, . . . $D1(30_M)$–$DNM(30_M)$, and/or remote controllers 40, to the security console 20, and from the security console 20 to any of the signaling devices 50. The coded signal 480 includes a unique and fixed device identification code 482 and a variable device identification code or rolling code 484. The unique identification code 482 of each of the peripheral devices $D1(30_1)$–$DN1(30_1)$, $D1(30_2)$–$DN2(30_2)$, . . . $D1(30_M)$–$DNM(30_M)$, and/or remote controllers 40 is stored in its memory 420. Likewise, the unique identification code 482 of the security console 20 is stored in its memory 102. In addition, software installed in the memory 420 of each of the peripheral devices $D1(30_1)$–$DN1(30_1)$, $D1(30_2)$–$DN2(30_2)$, . . . $D1(30_M)$–$DNM(30_M)$ is executed by the processor 410 during operation of the peripheral device $D1(30_1)$ $DN1(30_1)$, $D1(30_2)$–$DN2(30_2)$, . . . $D1(30_M)$–$DNM(30_M)$ to generate the rolling code 484 in accordance with a predetermined arithmetic equation. Likewise, software installed in the memory 102 of the security console 20 is executed by the micro-controller 100 during operation of the security console 20 to generate the rolling code 484 in accordance with a predetermined arithmetic equation.

Figure 5:
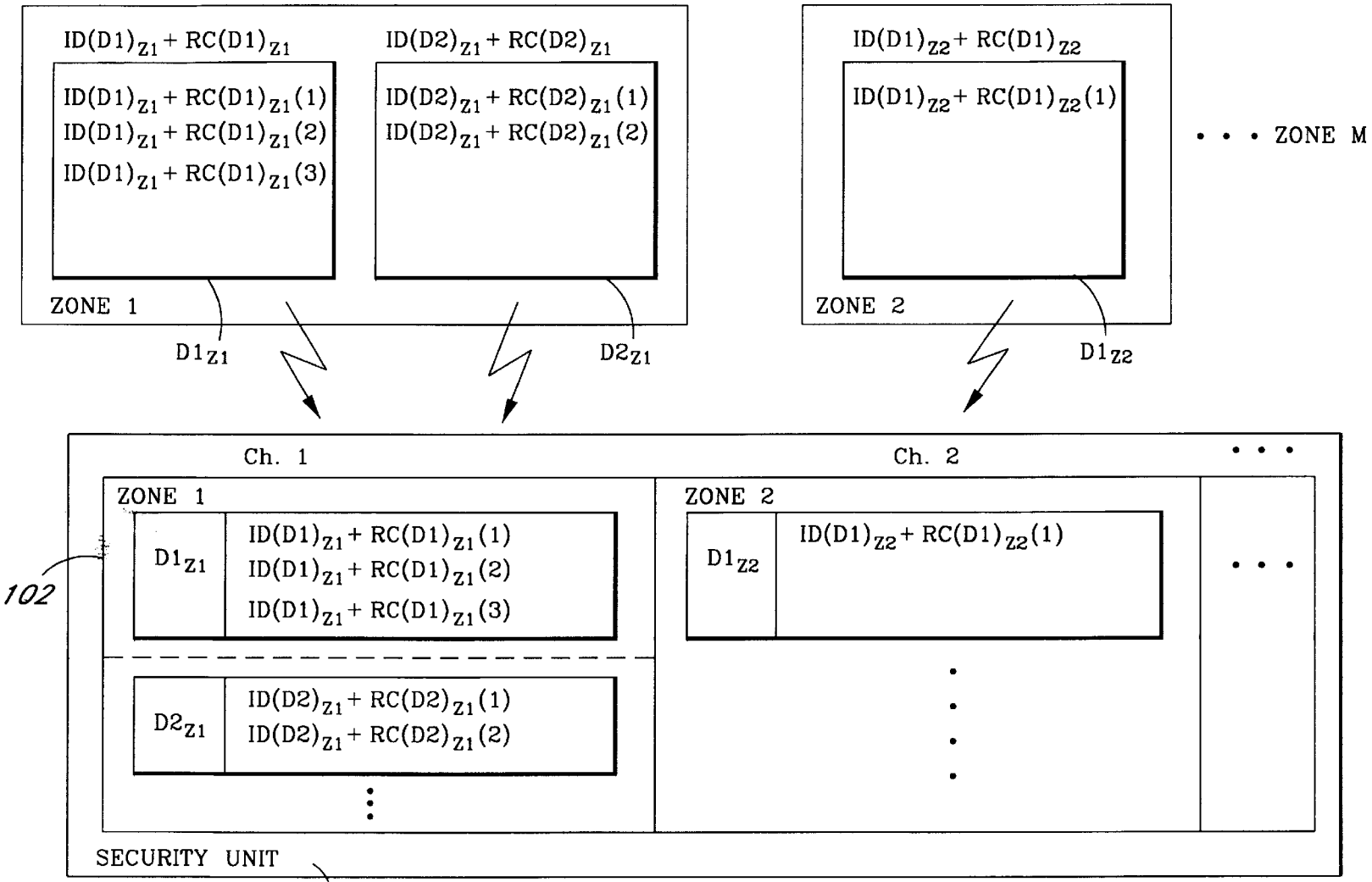
FIG. 5 illustrates one embodiment of the signal identification process implemented in the security system 10 of the present invention.

The software for executing the predetermined arithmetic equation in the security console 20 operates both to generate a code for transmission to a signaling device 50 and to verify a code received from a peripheral device or remote controller 40. Upon initially installing and enabling a peripheral device (any of $D1(30_1)$–$DN1(30_1)$, $D1(30_2)$–$DN2(30_2)$, . . . $D1(30_M)$–$DNM(30_M)$ or remote controller 40; for discussion purposes, $D1_{Z1}$ as shown in FIG. 5 will be referred to), the peripheral device emits a signal to the security console 20, which forwards its unique and fixed device identification code 482 and an initial rolling code 484. The unique identification code 482 and the initial rolling 484 are stored in the memory 102 of the security console. A similar initialization sequence occurs between the security console 20 and the signaling devices 50, which is described in greater detail below. Since the arithmetic equation for generating the initial and subsequent instances of the rolling code 484 is stored in the memory of both the peripheral device $D1_{Z1}$ and the security console 20, the security console 20 will be able to correctly identify subsequent transmissions from the peripheral device $D1_{Z1}$. In addition, since the rolling code 484 is variable, potential violation of the security system 10 of the present invention will be extremely difficult, especially in cases where the rolling code includes a large string of numbers. As a result, the security of the premises will be greatly enhanced.

The security console 20 is configured to separately monitor the identification code and the rolling code sequence of each activated peripheral device $D1(30_1)$–$DN1(30_1)$, $D1(30_2)$–$DN2(30_2)$, . . . $D1(30_M)$–$DNM(30_M)$, and upon receipt of each signal, the micro-controller 100 would generate the expected rolling code sequence associated with a particular identification code (and hence, a particular peripheral device). If there is a match, the received signal will be considered valid. The associated command (e.g., disarm, initiate transmission due to security breach, or to open a door) will then be acknowledged and the associated action will be taken.

FIG. 5 illustrates one embodiment of the signal identification process implemented in the security system 10 of the present invention. As shown, upon activation of the peripheral device $D1_{Z1}$ in zone 1, a signal which includes the identification code $ID(D1)_{Z1}$ and an initial rolling code $RC(D1)_{Z1}(1)$ is transmitted to the security console 20. As discussed earlier, the initial rolling code $RC(D1)_{Z1}(1)$ and subsequent variations of the rolling code $RC(D1)_{Z1}(n)$ are generated by software installed in memory of the peripheral device $D1_{Z1}$ in accordance with a predetermined arithmetic equation. This software is also installed in the memory 102 of the security console 20.

The identification code $ID(D1)_{Z1}$ and the initial rolling code $RC(D1)_{Z1}(1)$ are received by the security console 20 and stored in memory 102. Upon detection of motion or upon the breaking of a security contact, the peripheral device $D1_{Z1}$ will transmit a second signal to the security console 20. This second signal from the peripheral device $D1_{Z1}$ will include identification code $ID(D1)_{Z1}$ and a second rolling code $RC(D1)_{Z1}(2)$ generated in accordance with the predetermined arithmetic equation. Since the software for generating the rolling code sequences $RC(D1)_{Z1}(1)$, $RC(D1)_{Z1}(2)$, . . . , $RC(D1)_{Z1}$ (n) is also installed on the security console 20, upon receipt of the second signal, the micro-controller 100 (FIG. 2) first generates the expected rolling code $RC(D1)_{Z1}(2)$ associated with the identification code $ID(D1)_{Z1}$ and then compares the received second signal with the identification code $ID(D1)_{Z1}$ and expected rolling code $RC(D1)_{Z1}(2)$. If there is a match, the second signal will be considered a valid signal. In response, the security console 20 may transmit a signal to one of its signaling devices 50 (FIG. 1) (such as an emergency dialer), which subsequently sends a signal to one or more outside phones, to alert designated personnel that there is a security breach. Alternatively, the security console 20 may be configured to generate an alarm or a chime using the sound generation circuit 130. In addition, the associated LED 26*d*1 or 28*d*1 will light up, indicating that there is a security breach in zone 1.

Upon detection of a further instance of motion or upon the breaking of a security contact, the peripheral device $D1_{Z1}$ will transmit a third signal to the security console 20. This second signal from the peripheral device $D1_{Z1}$ will include identification code $ID(D1)_{Z1}$ and a third rolling code $RC(D1)_{Z1}(3)$ generated in accordance with the predetermined arithmetic equation. Upon receipt of the third signal, the micro-controller 100 (FIG. 2) generates the expected rolling code $RC(D1)_{Z1}(3)$ associated with the identification code $ID(D1)_{Z1}$ and then compares the received second signal with the identification code $ID(D1)_{Z1}$ and expected rolling code $RC(D1)_{Z1}(3)$. If there is a match, the third signal will be considered a valid signal.

Other installed peripheral devices such as $D2_{Z1}$ in zone 1 and $D1_{Z2}$ in zone 2 operate in a similar manner. However, the generation of signals from either of these peripheral devices $D2_{Z1}$ and $D1_{Z2}$ may be offset in time from that of the peripheral device $D1_{Z1}$. For example, while the peripheral device $D1_{Z1}$ may have transmitted its third signal which includes the identification code $ID(D1)_{Z1}$ and the rolling code $RC(D1)_{Z1}(3)$, the peripheral device $D2_{Z1}$ in zone 1 will be generating its second signal which includes its identification code $ID(D2)_{Z1}$ and the rolling code $RC(D2)_{Z1}(2)$. While the rolling code $RC(D1)_{Z1}(3)$ associated with the peripheral device $D1_{Z1}$ may be generated using the same arithmetic equation as the rolling code $RC(D2)_{Z1}(2)$ associated with $D2_{Z1}$, the rolling codes $RC(D1)_{Z1}(3)$ and $RC(D2)_{Z1}(2)$ are different since they are offset in sequence. In alternate embodiments, different arithmetic equations may be used to generate the rolling codes $RC(D1)_{Z1}$ and $RC(D2)_{Z1}$.

In addition, while the peripheral devices $D1_{Z1}$ and $D2_{Z1}$ in zone 1 have generated their third and second signals respectively (and before they generate further signals), the peripheral device $D1_{Z2}$ in zone 2 may be activated to generate its first signal, which includes $ID(D1)_{Z2}$ and its initial rolling code $RC(D1)_{Z2}(1)$. While peripheral devices in two zones have been described, it is contemplated that one or more zones each having at least one peripheral device may be likewise monitored, thus providing a security system that provides increased security.

The above described process may also be implemented using any one of the remote controllers 40. Each remote controller 40 may be used to disarm the security system 10 to facilitate entry to or exit from the premises, or to facilitate movement within a secured area.

Figure 6:
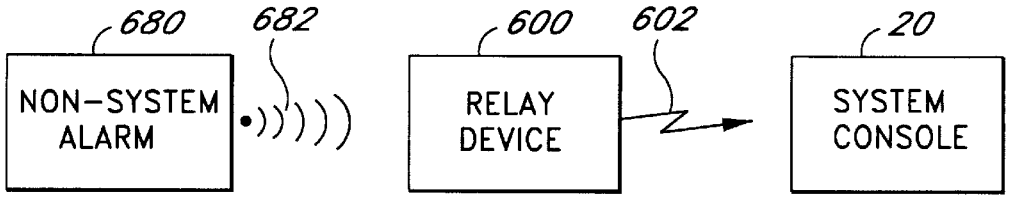
FIG. 6 is a block diagram illustrating the use of a relay device.

The use of the rolling code by the peripheral devices rather than just the remote controllers increases security by making it more difficult to intercept system codes and reduces the incidence of false alarms by making the recognition of noise or non-system signals as a valid signal much less likely. As illustrated in FIG. 6, the advantages of rolling code transmission can be extended to non-system alarm devices 680 that produce a local audible alarm 682 by the use of an audible alarm relay device 600 to detect the local audible alarm and transmit a device code including a rolling code by a radio frequency signal 602 to the system console 20.

To maintain a high level of security, the audible alarm relay device 600 must reliably detect the local audible alarm 682 of the non-system device 680 without false alarms. An exemplary non-system device producing a local audible alarm is a smoke detector. A typical smoke detector produces an alarm tone with a strong signal of a predetermined frequency in the range of 2.5 to 3.5 kilohertz (kHz). While the alarm tone is readily detected, a large number of false alarms will also be generated unless measures are taken to discriminate against signals other than the audible alarm. The audible alarm relay device of the present invention provides several novel techniques for discriminating against non-alarm signals with a circuit that conserves power to provide a long battery life.

The typical alarm signal can be detected at a single well-defined predetermined frequency. As shown in the exemplary block diagram of FIG. 7, the audible alarm relay device 600 of the present invention uses a tone detector 620 to limit the device response to frequencies that are within about two to three percent of a predetermined center frequency. The center frequency is chosen to be about the output frequency of the audible alarm being monitored. A suitable tone detector is the LMC567 produced by National Semiconductor Corp. The very narrow frequency response significantly improves the rejection of spurious signals over prior art devices which typically respond to signals in a frequency range of 15% or more. A frequency tuning adjustment 622 is provided to tune the response of the relay device to the alarm being monitored since the narrow response range precludes making a device that is universally responsive to a variety of non-system audible alarms without specific adjustment.

Discrimination of the relay device 600 is further enhanced by the use of timing circuits. One timing circuit 640 requires that a valid alarm signal 682 be detected for a predetermined length of time before the alarm signal is considered valid. A detect time between five and fifteen seconds will provide acceptably quick response while rejecting transient false alarms. Because of the discrimination provided by the narrow frequency detection range, the time required for an alarm to be considered valid has been significantly reduced from prior art devices which required the audible alarm to be detected for about one minute to be considered valid. Thus, the present invention can provide a response to an audible alarm as much as ten times faster than prior art devices.

The audible alarm may be briefly interrupted, either intentionally, as in devices that produce rapid tone bursts, or by unanticipated factors. A second timing circuit, such as a pause rejection circuit 630, provides pause rejection and is used to maintain a valid signal indication during interruptions in the audible alarm of up to one second. This allows tone burst signals to be detected and prevents delays in detecting audible alarms that are briefly interrupted for any reason. The two timing circuit work cooperatively and when a signal is produced by the microphone that satisfies the timing requirements, the tone detector 620 is enabled to determine if the signal falls within the appropriate frequency band.

The present embodiment includes a microphone 614 and associated amplification 610 for detecting an audible alarm. A signal of appropriate amplitude must be provided to the tone detector 620 to insure reliable alarm detection. The tone detector 620 of the present invention operates reliably with a microphone signal of as little as 35 millivolts root-mean-squared ($mV_{rms}$) to as much as 2 volts peak to peak ($V_{p-p}$). In one embodiment of the invention (not shown), an automatic gain control (AGC) circuit provides a microphone signal of appropriate amplitude from a wide range of input amplitudes from the microphone 614. In another embodiment of the invention, the range of acceptable input levels at the tone detector 620 allows microphone amplification 610 without AGC. An adjustment 612 is provided to set the microphone sensitivity to a predetermined level suitable for the non-system alarm 680 at the installed distance from the relay device 600. The embodiment with adjustably predetermined sensitivity of the microphone provides discrimination against low amplitude spurious signals that could be amplified and detected by the embodiment with an AGC.

In one embodiment of the invention, the alarm relay device 600 may be implemented without the rolling code technique. When a valid alarm signal 682 is detected by the microphone 614 and qualified by the pause reject 630, timer 640, and tone detector 620, the transmitter 650 transmits a signal 602 to the security console 20. In this way, the non-system audible alarm 680 functions as a system alarm that provides an alarm indication to the security console. Because this embodiment of the invention does not employ the previously described rolling code, the invention can be used with security consoles that do not implement the rolling code signaling system.

In a preferred embodiment of the invention, detecting a valid alarm signal 682 causes the transmitter to transmit a unique identification code for the device including a rolling code and causes the code generator 660 to update the rolling code, as previously described. When the system console 20 cooperatively receives a signal 602 from the relay device 600 that includes the rolling code, system security and reliability are enhanced.

Detecting a valid alarm signal 682 also triggers a muting timer 670 that suppresses the microphone input for a predetermined length of time. In one embodiment of the invention, microphone input is suppressed for about 20 seconds. Muting prevents the relay device from transmitting a series of alarm signals in rapid succession and prevents RF interference from the transmitter through the microphone. Some or all of the functions of the relay device may be implemented by a microcontroller.

Figure 7:
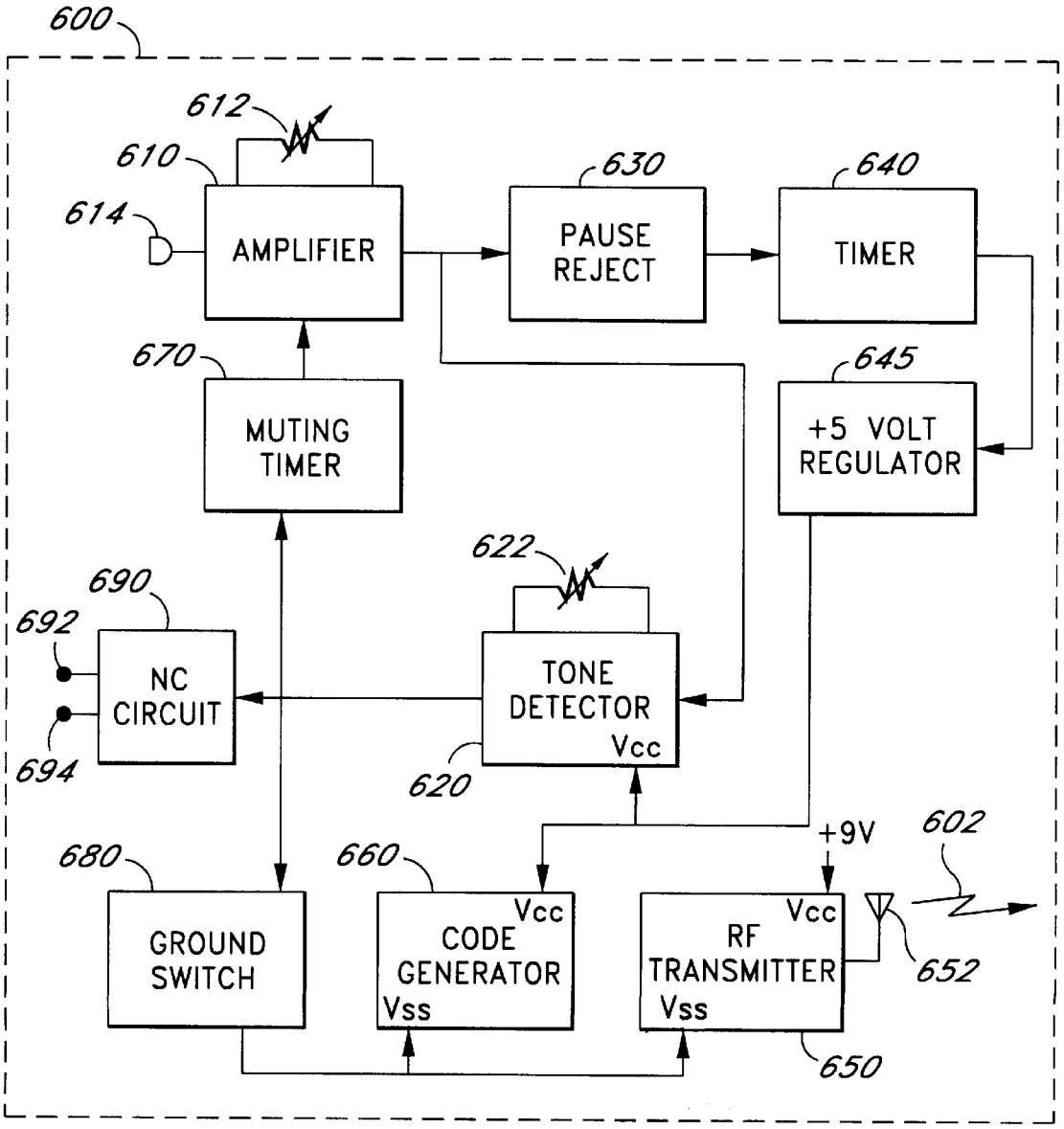
FIG. 7 is a detailed block diagram of a relay device.

There are several novel power conservation aspects to the circuit arrangement of the audible alarm relay device 600 as illustrated by the exemplary block diagram of FIG. 7. Only the amplifier 610, muting timer 670, pause reject 630, and timer 640 circuits are powered in the standby mode. In standby mode power consumption is typically about 140 microamperes.

If sound is detected by the timer 640 for a sufficient period of time, such as 5 to 15 seconds, then the 5 volt regulator 645 is turned on for a short period of time, typically about 2 seconds. This enables the tone detector 620 and places the relay device 600 in the tone detect mode. The tone detector has a power consumption of as much as 800 microamperes when operated from a 5 volt supply. The power consumption would be as much as 1.3 milliamperes if operated from the continuous 9 volt supply.

If the tone detector 620 detects a tone in the narrow detection band, then the ground path is closed by the ground switch 680 for the code generator 660 and the RF transmitter 650; the 5 volt regulator as controlled by the timer 640 provides the positive power for these circuits. This places the relay device 600 in the maximum power code transmit mode. In code transmit mode power consumption is typically about 11 milliamperes. It may be seen that a very substantial power saving is obtained by using the low power sound detection circuits to control power to the high power tone discrimination and code transmitting circuits.

Tone detection also triggers the muting timer 670 to disconnect the microphone 614 from the amplifier 610 for a period of time, typically 10 to 30 seconds. This forces the relay device 600 to return to standby mode. This also prevents radio frequency interference through the microphone during code transmission. After a suitable delay, such as 5 to 15 seconds, the muting timer 670 reconnects the microphone 614. It will then be at least 5 to 15 seconds more before the timer 640 places the device in the tone detect mode. In this way, the relay device is caused to remain in the low power standby mode for a significant proportion of the time even in the presence of a continuous tone of the correct frequency to trigger the relay device.

The power saving aspects of this embodiment of the inventive circuit allow the relay device to operate for about five months from a typical 9V alkaline battery with a 500 milliampere-hour capacity as compared to a life of about two weeks in a relay device that uses a circuit arrangement that requires the tone detector 620 to be continuously powered.

Figure 8A:
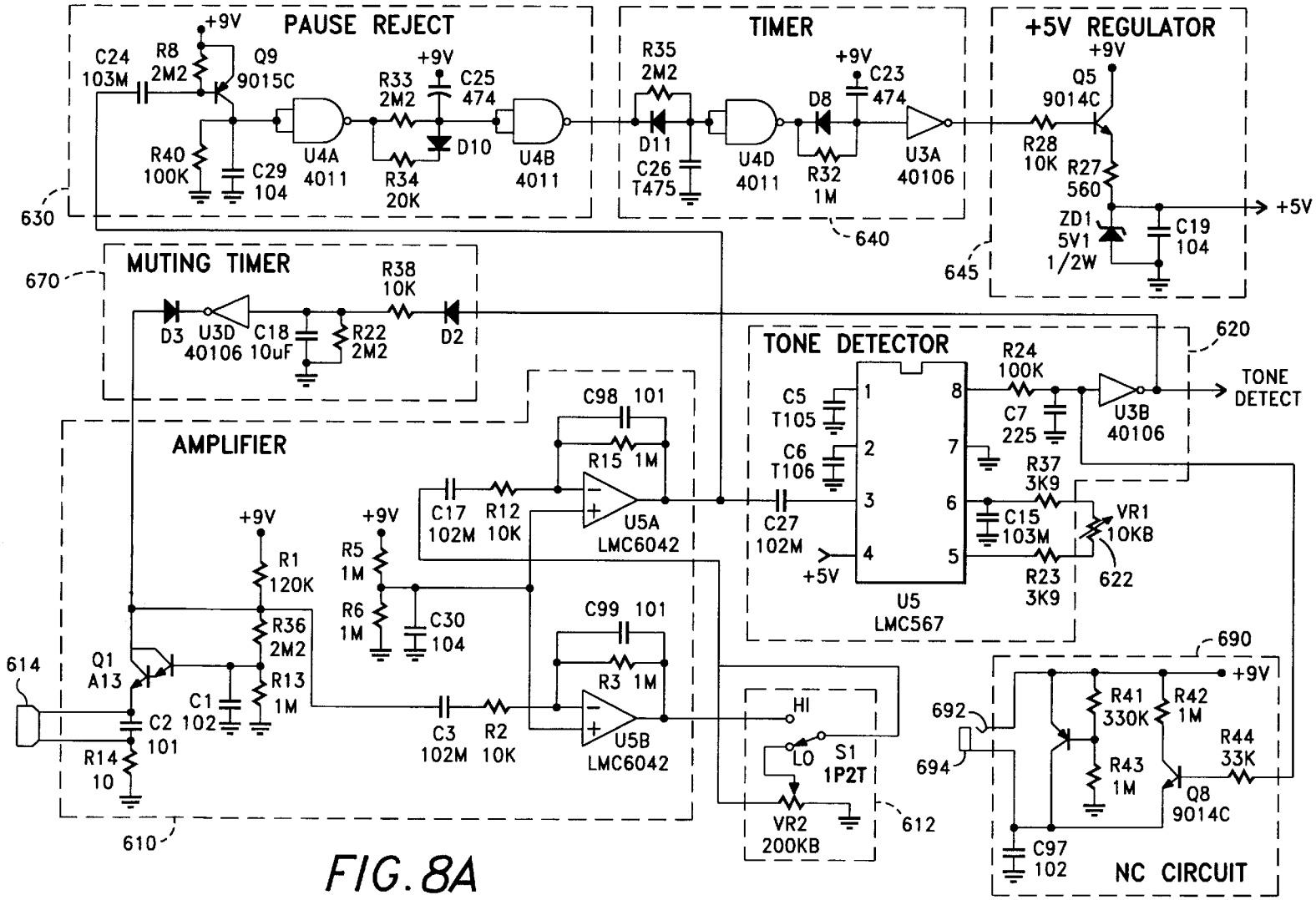
FIGS. 8A and 8B are a detailed circuit diagram for an embodiment of a relay device.
Figure 8B:
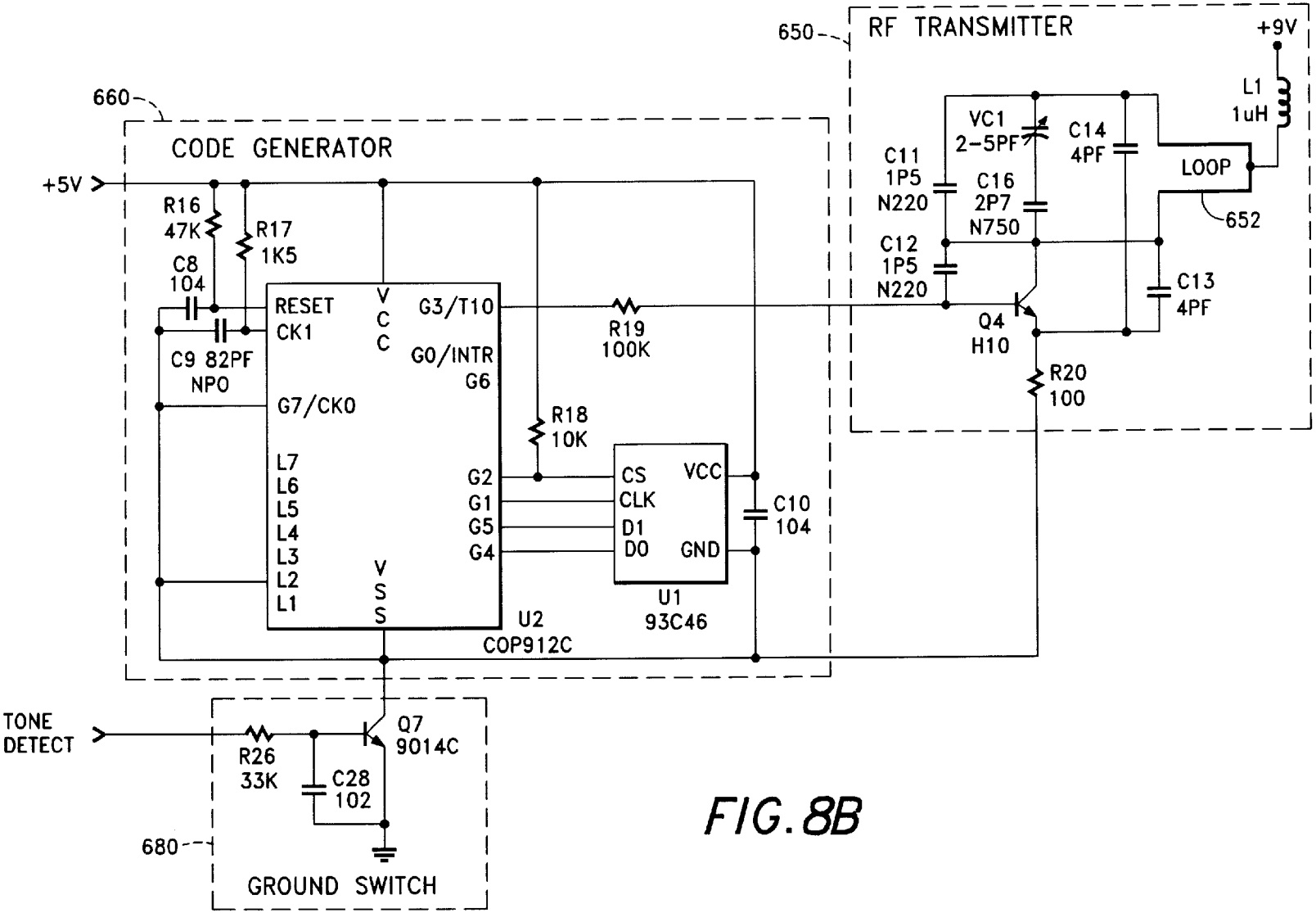

FIGS. 8A and 8B show a circuit diagram for an embodiment of the present invention. This circuit correspond generally to the block diagram of FIG. 7 and the blocks of FIGS. 8A and 8B are labeled accordingly. This circuit includes a LMC567 low power tone decoder from National Semiconductor Corporation in the tone detector block 620. The code generator block 660 includes a COP912C 8-bit microcontroller from National Semiconductor Corporation with a 1K serial EEPROM to provide a nonvolatile memory for the device code and the last transmitted rolling code.

The present invention, as illustrated by the foregoing embodiments, provides a security system having increased security by having peripheral devices, each having different identification codes which cannot be easily detected. In addition, the present invention provides a security system which improves immunity to spurious signals by transmitting a different data frame pattern during each transmission.

Further, the present invention provides a security system that can include non-system alarm devices that produce a local audible alarm signal and provide the benefits of the secure identification codes and changing transmissions. Still further, the present invention provides a relay device with the foregoing qualities that can be powered by a battery without requiring frequent battery replacements.

While the preceding description has been directed to particular embodiments, it is understood that those skilled in the art may conceive modifications and/or variations to the specific embodiments and described herein. Any such modifications or variations which fall within the purview of this description are intended to be included therein as well. For example, the alarm relay device can operate to transmit a conventional code rather than a rolling code for use with systems that do not employ the rolling code of the invention. Therefore, while an embodiment of the invention has been shown in the figures and described in the specification as having means for generating a rolling code to transmit to the security console, other embodiments of the invention may omit the rolling code generator. It is understood that the description herein is intended to be illustrative only and is not intended to limit the scope of the invention. Rather the scope of the invention described herein is limited only by the claims appended hereto.

What is claimed is:

1. An alarm relay device comprising:

a microphone producing a signal responsive to an audible alarm having a frequency;

a first circuit coupled to the microphone, said first circuit producing a first detect signal when the signal is above a predetermined level; and a second circuit coupled to the microphone and the first circuit, said second circuit receiving power responsive to the first detect signal and producing a second detect signal when the signal is within a predetermined range of the frequency.

2. The alarm relay device of claim 1, further comprising a voltage regulator coupled to the first circuit and the second circuit, said voltage regulator being turned on by the first detect signal, and providing power to the second circuit.

3. The alarm relay device of claim 1, further comprising a third circuit coupled to the microphone and the second circuit; said third circuit turning off the microphone for a predetermined length of time responsive to the second detect signal.

4. The alarm relay device of claim 1, further comprising a fourth circuit coupled to the second circuit; said fourth circuit receiving power responsive to the first detect signal and the second detect signal, and transmitting a signal responsive to the second detect signal.

5. The alarm relay device of claim 4, further comprising:

a memory coupled to the fourth circuit, said memory storing a device code to be transmitted by the fourth circuit, said device code including a predetermined identification code and a variable code, said variable code having a first value; and a fifth circuit coupled to the fourth circuit and the memory, said fifth circuit storing a second value for the variable code in the memory responsive to the fourth circuit transmitting the device code, where the second value is based on the first value.

6. The alarm relay device of claim 4, further comprising:

a voltage regulator coupled to the first circuit, the second circuit, and the fourth circuit, said voltage regulator being turned on by the first detect signal and providing power to the second circuit and the fourth circuit; and a ground switch coupled to the second circuit and the fourth circuit, said ground switch connecting the fourth circuit to ground responsive to the second detect signal.

7. The alarm relay device of claim 1, wherein the frequency is adjustable to respond to a local audible signal.

8. The alarm relay device of claim 1, wherein the microphone has a sensitivity that is adjusted to respond to the audible alarm at a predetermined level.

9. A alarm relay device comprising:

a microphone producing a signal responsive to an audible alarm having a frequency;

a first circuit coupled to the microphone, said first circuit producing a detect signal when the signal is within a predetermined range of the frequency;

a memory that stores a device code, said device code including a predetermined identification code and a variable code, said variable code having a first value;

a second circuit coupled to the first circuit and the memory, said second circuit transmitting the device code responsive to the detect signal; and a third circuit coupled to the second circuit and the memory, said third circuit storing a second value for the variable code in the memory responsive to the second circuit transmitting the device code, where the second value is based on the first value.

10. The alarm relay device of claim 9, further comprising a fourth circuit coupled to the second circuit, said fourth circuit causing the second circuit to transmit the device code when the detect signal is continuously received for more than a predetermined period of time.

11. The alarm relay device of claim 10, further comprising a fifth circuit coupled to the first circuit, said fifth circuit to maintain the detect signal during a short period of time when the signal is below the predetermined level.

12. The alarm relay device of claim 11, wherein at least one of the first circuit, the second circuit, the third circuit, the fourth circuit, and the fifth circuit is a microcontroller.

13. A security system comprising:

an alarm relay device including a microphone producing a signal responsive to an audible alarm having a frequency, a first circuit coupled to the microphone, said first circuit producing a first detect signal when the signal is above a predetermined level, and a second circuit coupled to the microphone and the first circuit, said second circuit receiving power responsive to the first detect signal and transmitting a second detect signal when the signal is within a predetermined range of the frequency; and a security console including a receiver to receive the second detect signal, an alarm circuit coupled to the receiver, said alarm circuit signaling presence of the audible alarm when the second detect signal is received.

14. The security system of claim 13, wherein the alarm relay device further includes a voltage regulator coupled to the first circuit and the second circuit, said voltage regulator being turned on by the first detect signal, and providing power to the second circuit.

15. The security system of claim 13, wherein the alarm relay device further includes a third circuit coupled to the microphone and the second circuit; said third circuit turning off the microphone for a predetermined length of time responsive to the second detect signal.

16. The security system of claim 13, wherein the alarm relay device further includes a fourth circuit coupled to the second circuit; said fourth circuit receiving power responsive to the first detect signal and the second detect signal, and transmitting a signal responsive to the second detect signal.

17. The security system of claim 16, wherein the alarm relay device further includes a memory coupled to the fourth circuit, said memory storing a device code to be transmitted by the fourth circuit, said device code including a predetermined identification code and a variable code, said variable code having a first value, and a fifth circuit coupled to the fourth circuit and the memory, said fifth circuit storing a second value for the variable code in the memory responsive to the fourth circuit transmitting the device code, where the second value is based on the first value.

18. The security system of claim 16, wherein the alarm relay device further includes a voltage regulator coupled to the first circuit, the second circuit, and the fourth circuit, said voltage regulator being turned on by the first detect signal and providing power to the second circuit and the fourth circuit, and a ground switch coupled to the second circuit and the fourth circuit, said ground switch connecting the fourth circuit to ground responsive to the second detect signal.

19. The security system of claim 13, wherein the frequency is adjustable to respond to a local audible signal.

20. The security system of claim 13, wherein the microphone has a sensitivity that is adjusted to respond to the audible alarm at a predetermined level.

21. A security system comprising:

an alarm relay device including a microphone producing a signal responsive to an audible alarm having a frequency, a first circuit coupled to the microphone, said first circuit producing a detect signal when the signal is within a predetermined range of the frequency, a memory that stores a first device code, said first device code including a predetermined identification code and a variable code, said variable code having a first value, a second circuit coupled to the first circuit and the memory, said second circuit transmitting the first device code responsive to the detect signal, and a third circuit coupled to the second circuit and the memory, said third circuit storing a second value for the variable code in the memory responsive to the second circuit transmitting the first device code, where the second value is based on the first value;

a security console including a console memory that stores a second device code, said second device code including a second predetermined identification code and a second variable code, said second variable code having a third value, a receiver to receive the first device code, an alarm circuit coupled to the receiver, said alarm circuit signaling an alarm condition if the first device code matches the second device code;

a code update circuit coupled to the alarm circuit and the console memory, said code update circuit storing a fourth value for the second variable code in the console memory responsive to the alarm circuit signaling an alarm condition, where the fourth value is based on the third value.

22. The alarm relay device of claim 21, wherein the alarm relay device further includes a fourth circuit coupled to the second circuit, said fourth circuit causing the second circuit to transmit the first device code when the detect signal is continuously received for more than a predetermined period of time.

23. The alarm relay device of claim 22, wherein the alarm relay device further includes a fifth circuit coupled to the first circuit, said fifth circuit to maintain the detect signal during a short period of time when the signal is below the predetermined level.

24. The alarm relay device of claim 23, wherein at least one of the first circuit, the second circuit, the third circuit, the fourth circuit, and the fifth circuit is a microcontroller.

25. A method of transmitting a local audible signal to a security console, comprising:

detecting a signal having a frequency from a microphone when the signal is above a predetermined level;

providing power to a tone detector circuit when the signal is detected;

detecting a tone when the signal is within a predetermined range of the frequency; and providing power to a code transmitter when the tone is detected for a predetermined length of time; and transmitting a code to the security console with the code transmitter while power is provided to the code transmitter.

26. The method of claim 25, further comprising turning off the microphone for a predetermined length of time when the tone is detected.

27. The method of claim 25, wherein transmitting the code further includes storing the code to be transmitted, said code including a predetermined identification code and a variable code, said variable code having a first value, and storing a second value for the variable code after transmitting the code, where the second value is based on the first value.

28. The security system of claim 25, further comprising adjusting the frequency to respond to a local audible signal.

29. The security system of claim 25, further comprising adjusting the predetermined level to respond to the audible alarm.

30. A method of transmitting a local audible signal to a security console, comprising:

storing a device code in a memory, said device code including a predetermined identification code and a variable code, said variable code having a first value;

detecting a signal from a microphone when the signal is within three percent of a predetermined frequency;

transmitting the device code when the signal is detected;

storing a second value for the variable code in the memory after the second circuit transmits the device code, where the second value is based on the first value.

31. The method of claim 30, further comprising transmitting the device code when the signal is continuously detected for more than five seconds.

32. The method of claim 30, further comprising transmitting the device code when the signal is continuously detected for more than five seconds without any interruptions that are longer than one-half second.

* * * * *